US007647962B2

(12) United States Patent
Ruggeri et al.

(10) Patent No.: US 7,647,962 B2
(45) Date of Patent: Jan. 19, 2010

(54) ASSEMBLY AND METHOD OF ALTERNATIVE PUMPING USING HOLLOW RODS WITHOUT TUBING

(75) Inventors: Jorge Ruggeri, Buenos Aires (AR); Omar Bianchetti, Buenos Aires (AR); Jose L. Scaramuzza, Buenos Aires (AR)

(73) Assignee: YPF Sociedad Anonima, Buenos Aires (AR)

( * ) Notice: Subject to any disclaimer, the term of this patent is extended or adjusted under 35 U.S.C. 154(b) by 52 days.

(21) Appl. No.: 11/447,606

(22) Filed: Jun. 6, 2006

(65) Prior Publication Data

US 2006/0278398 A1 Dec. 14, 2006

(30) Foreign Application Priority Data

Jun. 7, 2005 (AR) ..... P20050102319

(51) Int. Cl.
*E21B 27/00* (2006.01)

(52) U.S. Cl. ..... 166/108; 166/105; 166/68; 166/68.5; 166/107

(58) Field of Classification Search ..... 166/369, 166/373, 382, 72, 325, 105, 107, 108, 109, 166/110, 111, 68, 68.5, 370
See application file for complete search history.

(56) References Cited

U.S. PATENT DOCUMENTS 2,394,189 A * 2/1946 Kaufman ..... 166/304
4,089,626 A 5/1978 Hill et al.
4,360,288 A 11/1982 Rutledge, Jr. et al.
4,476,923 A 10/1984 Walling
4,592,421 A 6/1986 Hoffman et al.
4,948,003 A 8/1990 Munoz
5,667,369 A 9/1997 Cholet
5,979,550 A * 11/1999 Tessier ..... 166/212
6,186,238 B1 2/2001 Tornquist
2003/0141054 A1* 7/2003 Wade et al. ..... 166/250.01
2004/0026085 A1* 2/2004 Vacik et al. ..... 166/373
2006/0108125 A1* 5/2006 Azar ..... 166/382
2006/0169458 A1* 8/2006 Jones, Jr. ..... 166/369

FOREIGN PATENT DOCUMENTS

CN 1134500 10/1996

* cited by examiner

*Primary Examiner*—Jennifer H Gay
*Assistant Examiner*—Brad Harcourt
(74) *Attorney, Agent, or Firm*—The Webb Law Firm

(57) ABSTRACT

Assembly and method for extracting fluids, preferably crude oil, from a drilled well within a geological formation by means of reciprocating pumping with hollow sucker rods. The assembly includes: a) a stationary bottom set that attached to the casing at the desired depth and providing the rod pump anchoring system; b) a reciprocating axial movement rod pump having an anchoring system and a centralizer; c) a centralized hollow rod string extending within the well, which is connected to the mobile member of the pump; d) a hollow polished rod connected to the hollow rod string and linked to a system that imparts the reciprocating axial movement to the pump; e) a production bridge connecting the polished rod to the driving tubing through rotating joints, and f) a rigid head that provides a venting exit of the annular space formed between the string and the casing.

19 Claims, 7 Drawing Sheets

ASSEMBLY AND METHOD OF ALTERNATIVE PUMPING USING HOLLOW RODS WITHOUT TUBING

FIELD OF THE INVENTION

The present invention relates to an assembly and method for extracting fluids, preferably crude oil, from a drilled well within a geological formation by means of reciprocating pumping with hollow sucker rods. In particular, the system comprises the use of a string of hollow centered rods, which are able to transport/extract the effluents to the surface through their inner bore and, at the same time, to impart the reciprocating axial movement in relation to the subsurface pump.

BACKGROUND OF THE INVENTION

The economical or strategic importance of oil, is evident, therefore the possibility of increasing the production, as well as the usable reservoirs, is extremely attractive. However, new oil fields have not been found, and oil and gas reservoirs have been reduced in the last three years. In addition, the cost reduction is a constant existing need in all industries in order to increase the competitivity and profitability of the companies. In the case of oil production, the cost reduction increases the economically exploitable reservoirs, since oil is extracted provided the income is higher than the operative costs. In Argentina, where there are many mature oil fields exploited by means of secondary recovery where the average cut (water ratio in the extracted fluids) is over 90%, the idea of a productive alternative for reducing costs is particularly attractive.

Typically, once an underground formation capable of containing oil and/or gas is located, a well is drilled, and depending on the type of ground to be passed through and the final depth to be reached, it may begin with a diameter of about 12.¼" (311,15 mm) in the first 200/300 mts, of 8.½" (215,9 mm) at a higher depth, capable of reaching a depth of 400 mts up to 4500 mts or more. The greater diameter allows placing a steel line (guiding line or security line) which will be fixed to the ground by means of a forced introduction of cement in the annular space between the tube and the ground. The blow out prevention (BOP) valve will be located above said tubing during the drilling with the smaller diameter. Following this drilling of smaller diameter, it is required to introduce a tubular steel lining, namely casing of about 5.½" (139,7 mm) diameter extending along the whole well bore. As well as with the security line, the forced introduction of cement in the annular space between the casing and the walls of the borehole from the bottom to a height beyond the areas of interest will allow to fix the casing once the cement is forged.

Following the above operation, punctures are made at preselected depths, in accordance with the nature of the reservoir, which go through both the casing wall and the cement sheath, allowing a free access of production fluids from the formation to the well bore.

In some regions, the pressure of the reservoir fluids itself is sufficient to allow the natural lift of the fluids to the surface, rendering a flowing well. However, reservoirs are generally not eruptive, being necessary to extract the fluids entered into the well in an artificial manner by means of a pumping system.

A conventional reciprocating pumping well includes, in addition to the casing, the production line or tubing within which the produced fluids are passed from the bottom to the surface. At the bottom of the well and anchored in the production tubing, there is a reciprocating axial pump of barrelrod type. This pump is mechanically actuated by an oscillating lever pivotally assembled on the surface, connecting in one end to a driving source and in the other to a series of solid steel rods connected each other to form a string which extends within the well, being connected by its lower end to the mobile part of the deep well pump and imparting it the reciprocating movement of the oscillating lever. In this way, the pumped fluids ascend to the surface trough the annular space defined between the production tubing and the rod string.

The solid rods movement within the production tubing involves a frictional contact between both, thus producing the rod and/or production tubing break and damages to the system. This problem increases in deviated or crooked holes. The high number of interventions in holes due to this problem generates high maintenance costs and increased production losses.

In such system, the production tubing cost is a significant part of the total investment.

The conventional pumping system with production tubing provides low pumping efficiency due to its stretching and shortening, which occurs with the change of direction of the rod string between ascending and descending movement.

Another relevant disadvantage of the system is that, whenever a service on the pump is needed in the fixed tubing system (when due to its size the pump is fixed to the production tubing) it is necessary to remove the rod string and the production tubing, thus increasing the hole intervention and interruption times, with the corresponding rise in costs, and loss of production.

Among the attempts to reduce costs, we can mention some patents that tend to reduce the rods' weight in order to require less energy for its operation, although the energy required in this system is not directly related to the loads, since these regenerate energy during the ascending movement. Among these patents, we can mention the following:

AR patent No. 230316 refers to a pumping rod, essentially made of fiber glass, with a significantly lower weight.

AR patent No. 234862 suggests the replacement of the rod string with a fiberglass rod string with no mutual contact, in order to achieve a lower weight of the rods.

Other attempts have proposed the use of continuous coiled tubing in order to replace the solid rod string. Among them, we can mention the following:

U.S. Pat. No. 5,667,369 (H. Cholet) proposes the replacement of the sucker rods with a continuous coiled tubing that has a PCP type pump rotor (progressive cavity pump) bound to its bottom end, and wherein the corresponding stator is bound to the base of a production tubing. In this case, the pump activation is carried out by means of a rotating movement of the continuous tubing, lower in weight and easy to handle, but the use of the production tubing is maintained.

The AR published application No. 0010430 (YPF S.A.), (U.S. Pat. No. 6,186,238) proposes to replace the combination of solid pumping rods and production tubing in the conventional reciprocating pumping system by a continuous coiled tubing. Among its advantages, this system has a fast downloading handling as well as a fast pump extraction. The great flexibility helps its coiling, however, it reduces the strength to absorb compression efforts and buckling during the ascending run, thus increasing the possibility of friction against casing walls, particularly in deep wells. Consequently, this system is successfully applied in shallow and low production wells. In addition, once broken, the continuous tubing must be bound by welding, thus reducing the resistance against weariness in said area. This reduction is enhanced by the amount of splices, considerably reducing the life of the continuous tubing that may derive in a total change of it. The continuous tubing system does not allow the use of vulcanized centralizers on the tubing body; only bayonet centralizers may be used, with no satisfactory results.

U.S. Pat. No. 4,476,923 (Walling), describes a coiled, composite tubing that allows the effluents to be conducted through its internal cavity. Such composite tubing supports, in its bottom end, a pump mechanically actuated by means of an electrical engine housed in the same deep well pump casing. The engine is electrically actuated from the surface by means of conductors extending along and across the composite tubing sheaths. Therefore, the composite tubing comprises a complex sequence of sheaths and wrappings made of different materials able to provide the resistance required to support this particular pumping system.

In U.S. Pat. No. 4,089,626, the hollow rods are used to inject chemical products to the bottom of the well. The possibility that the well fluids may be produced from its interior is not mentioned. Consequently, the production line (tubing) has not been removed in this patent.

U.S. Pat. No. 4,948,003 describes a method of taking crude samples wherein the hollow rods are used to inject chemicals, such as surfactants, that increase the viscous fluids mobility. However, a conventional solid rod tubing system is also used in this patent.

The Chinese Patent Application 95-104622.5 describes a production system with hollow rods that uses a flexible tube (hose) in the well head for the derivation of the fluids to the production tubing, accompanying the reciprocating movement of the rod string to the production tubing. This arrangement increases the environmental pollution risks due to the possibility of high pressure, several bent parts and harsh environments that may produce a malfunction in the flexible tube.

OBJECTS OF THE INVENTION

The main object of the invention is to provide an assembly and method for pumping, from the underground, an effluent produced by a drilled well within a geological formation that replaces the combination of solid sucker rods and production tubing of the conventional reciprocating pumping system with only one centered hollow sucker rod string, able to raise the effluents to the surface and at the same time, to transmit reciprocating axial movement to the deep well pump.

An important object of the invention is to provide a simple and robust bottom set, able to house and anchor reciprocating pumps of any size according to the casing diameter.

Another relevant object of this invention is to provide a rigid well bore head able to vent and pack the annular space formed between the rod string and the casing as well as to lubricate the external wall of a hollow rod in its reciprocating movement.

It is also an object of the invention to provide a safe production bridge to allow the distribution of the fluids produced from a well to the surface pipeline while simultaneously accompanies the axial reciprocating movement of the rod.

It is an important object of the invention to provide a robust device made from standard elements, easy to assemble, install and handle, able to raise high flow rates from very deep wells, such as 90 $m^3$/day and 2500 m dynamic height, to totally replace the conventional reciprocating pumping system with solid rods and production tubing.

A further main object of the invention is to provide a device and method for producing an effluent from a well, preferably an hydrocarbon well, which by means of the replacement of a conventional combination of solid rods and production tubing with a centered hollow rod, reduces the disadvantages of the prior art and allows a reduction in operative costs and capital.

The assembly and method of the invention have the following advantages with respect to the prior art:

- Reduce the intervention times (pulling): once the bottom set is fixed to the bottom end, the pump replacements, even those of great dimensions, are performed in just one run, due to the lack of production tubing.
- Increase the pumping efficiency due to the elimination of the elastic stretching of the production tubing during the reciprocating movement of the rod string and due to the removal of resistance by fluid friction during the ascending run.
- Reduce the elastic stretching of the rods due to lower weight of the fluid column and higher stiffness of the hollow rods due to having a bigger section.
- Reduce solids accumulation due to a higher fluid speed when passing through a smaller section.
- Reduce fluid heat loss with surrounding elements which decreases paraffin precipitation.
- Eliminate interventions due to production tubing breaks and fishing of sucker rods due to frictional wear between the rod and the production tubing.
- Eliminate interventions due to a loss between anchorage of the pump and its seating shoe.
- Eliminate fluid losses due to failures of the gaskets of the T-press, which significantly decreases the danger of environmental pollution.
- Reduce expenses for non destructive inspections in the production tubing and sucker rods.
- Eliminate spending on production tubing.
- Enable the use of big diameter pumps (over 2"-50,8 mm) in wells with 5.½" (139,7 mm) diameter casings and smaller (3.½"-883,9 mm slim hole), as insertable pumps (they are lowered suspended of the rod string in one run), which, in the conventional mechanical pumping, are pumps fixed to the production tubing.
- Eliminate the possibility of friction between the hollow rod string and the casing because there is an annular space of greater size and the use of centered rods thus avoiding the possible friction against the casing, and the subsequent rupture, pollution and loss in production.

SUMMARY OF THE INVENTION

The present invention relates to an assembly for extracting a fluid from a drilled well within a geological formation, which walls are secured by means of a casing that is perforated to pre-selected depth levels, wherein the assembly comprises:

a) a stationary bottom set that provides means to anchor a deep well pump to the casing;

b) a deep well pump with axial reciprocating movement consisting of a stationary member and a mobile member, an anchorage system in the bottom part and a centralizer in the upper part, these latter being integral to the stationary member;

c) a series of interconnected hollow rods, forming a string that extends within the well, which is connected by its bottom end to the mobile member of the deep well pump, so that the interior of the pump mobile member is in fluid communication with the interior of the hollow rod string;

d) a hollow polished rod which connects by its bottom end to the free upper end of the hollow rod string within the well, said hollow polished rod being linked to a system that imparts an axial reciprocating movement to the rod;

e) a production bridge linking the upper end of the hollow polished rod to the driving pipeline, which allows the recovery of the fluid pumped from within the hollow rods and said hollow polished rod, and f) a rigid head providing a gasket that packs the annular space between the hollow polished rod and the casing, equipped with a hollow rod lubricating device.

According to a preferred embodiment of this invention, it is hereby provided an assembly to pump fluid, such as, preferably a hydrocarbon, comprising:

a stationary bottom set that houses a deep well pump. Such set preferably consists of, from bottom to top, an anchor that allows its fixing to the desired depth and provides an admission orifice whereby the fluid to be pumped will enter, two shoes providing seats for mechanical and cup anchorage of the deep well pump, a centralizer that in combination with the anchor allows a perfectly concentric location of the set with respect to the casing walls and a connector set (on-off) that allows to carry out the descending maneuvers and the fixing of the stationary bottom set. Filters may be installed underneath the anchor, if needed. Preferably, although not in a limiting way, the stationary bottom set comprises a pump housing tube (housing) and a centralizer thereof;

a deep well pump (reciprocating axial conventional API type) consisting of a stationary member and a mobile member. Said pump has, in the bottom part and integral to the stationary member, two mechanical and cup anchorages with admission orifice of the fluid to the pump. In the upper part, the mobile member continues in a pull tube (hollow) adapted to bind the hollow rod string by means of the linking flow and drain tube allowing the fluid communication from within the pump to the interior of the hollow rods;

a linking flow tube, preferably threaded in both ends, binding the drain tube of the pump to the hollow rod string. Said linking tube is such that enables the flow circulation from the inside of the pump to the interior of the hollow rod string, and it preferably includes a drain plug that allows to empty the rod string during the pulling operation of the pump;

a hollow rod string with centralizers to avoid the friction against the casing. Said rods, preferably formed by a tubular with female threaded ends (box-box), are preferably interconnected by means of tubular sleeves with male threaded ends (pin-pin) to form a string extended towards the interior of the well. The bottom part of the string is linked to the deep well pump mobile member through the flow linking tube, the string upper part being connected to a hollow polished rod, such rod being linked to the device that imparts the axial reciprocating movement to the rod string;

a hollow polished rod consisting in a, preferably but not limited to, chromeplated hollow rod in its external wall. Such polished rod is coupled by its bottom end to the free upper end of the hollow rod string, preferably by means of a connecting sleeve within the well, and it prolongs outside the well coupling itself by its upper end to the production bridge that links the polished rod to the surface driving tubing. Said polished rod is connected to means that impart the axial reciprocating pumping movement. A lubricating device is provided for allowing the polished rod to work lubricated, said device packing the annular space between the polished rod and the casing. Since the production fluid flows inside the polished rod, there is no possibility of loosing fluids due to failure in the gasket, which significantly reduces the environmental pollution risk;

a production bridge formed by at least two articulate rigid tubes. Said rigid tubes are linked to each other by one end and to the hollow polished rod and the surface driving pipeline by the free ends. This linkage is preferably made by means of rotating joints. This arrangement, replacing the conventional T-press, allows the distribution of the fluids produced from within the polished rod to the surface driving pipeline, while at the same time accompanies the polished rod reciprocating movement;

a robust head providing a side exit that communicates the annular space formed by the rods and casing with the exterior of the well and an adaptor in the upper part allowing the installation of a seal box that locks the annular space between the polished rod and the casing. In the case of 3.½"-88,9 mm casing wells (slim hole), only a conventional compact T-press coupled to the casing which provides a side exit and the seal box which packs the annular space between the rod and the casing, will be used. In any of the arrangements the seal box also has a lubricating device to lubricate the polished rod since it works in dry conditions when the produced fluid flows inside thereof.

In addition, a method is provided to extract a fluid from a drilled well within a geological formation which walls are secured by means of a casing, perforated at selected depth levels, by the assembly of the present invention, wherein the stationary bottom set is lowered into the well upon its termination in an independent run, once the desired depth is reached. Next, once the stationary bottom set is fixed to the bottom, the deep well pump, centered coupled to the centered hollow rod string, is carried down in one run in a concentric position with respect to the casing walls until the stationary bottom set is reached where, due to the weight of the tool itself, it enters and is attached to its respective seats within the set. Subsequently, a hollow polished rod is connected to the free end of the hollow rod string above which a surface head is placed that provides a gasket between the polished rod and the casing while lubricating it. The polished rod is connected to a production bridge and is driven according to a reciprocating axial movement, recovering the fluid pumped by the inside of the hollow rod string and the hollow polished rod and delivered through the production bridge to the driving pipeline.

DETAILED DESCRIPTION OF THE INVENTION

Figure 1:
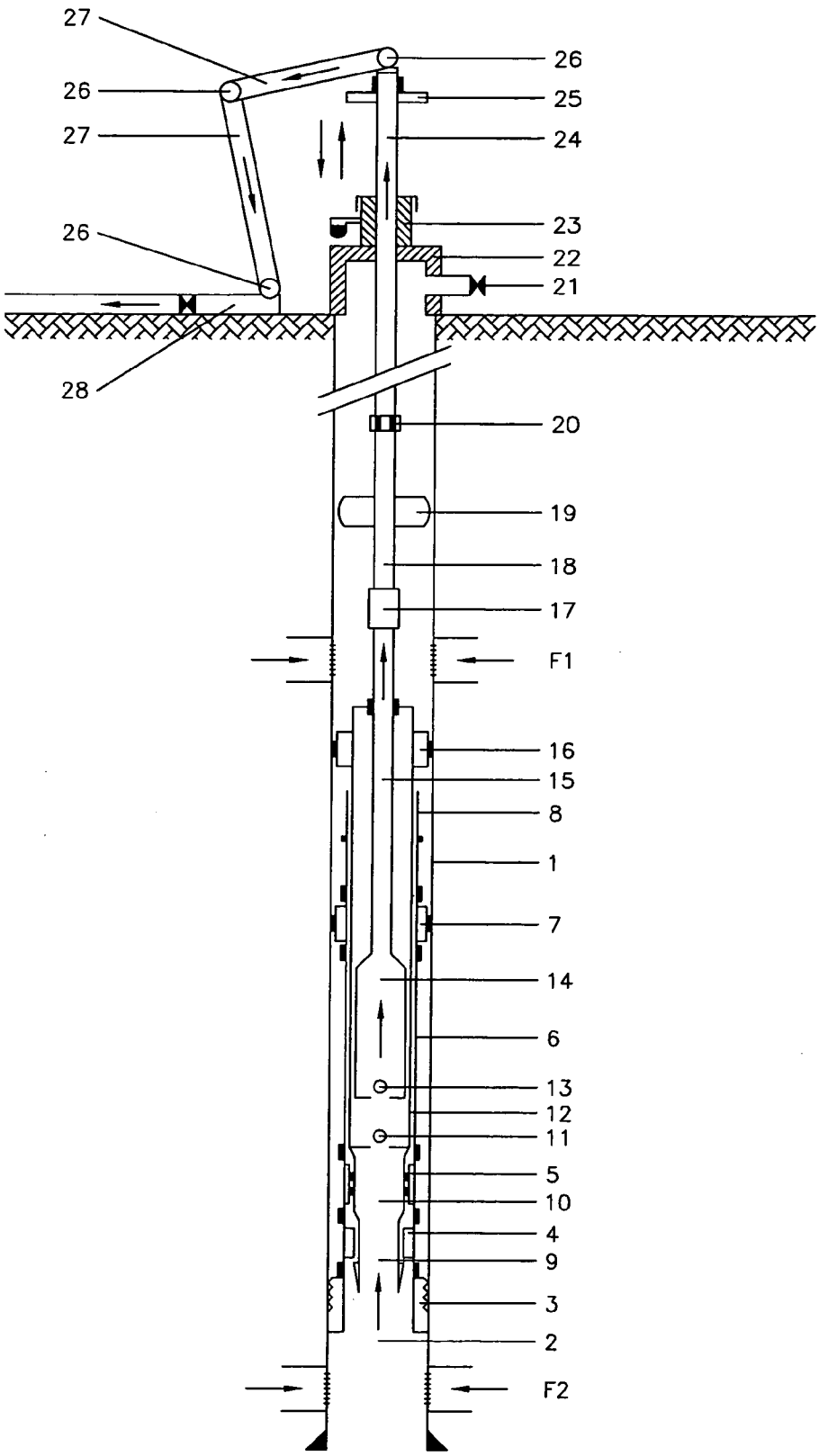
FIG. 1 is an schematic illustration of the reciprocating axial pumping device of the present invention.

FIG. 1 shows a perforation made in an effluent producing geological formation containing, for instance, hydrocarbons. The borehole wall is lining by a casing tube 1. Preferably, the tube 1 is fixed or anchored to the borehole wall by a concrete layer injected in the annular space between the casing external face 1 and the borehole face. At pre-selected depths zones, according to previous geological studies, the casing and the concrete are perforated or drilled to allow the free entry of fluid from the reservoir. Two fluid access layers (F1, F2) at different depths are illustrated in FIG. 1. In this case, a multilayer exploitation is illustrated.

In general, as shown by the scheme of FIG. 1, the reciprocating axial pumping system of the present invention, combines a rigid well head 22 that provides a casing venting exit 21, a hollow sucker rod string 18 with centralizers 19, a reciprocating axial deep well pump and a stationary bottom set that allows to anchor the reciprocating deep well pump. Once the stationary bottom set is fixed to the desired depth in an independent run, the deep well pump coupled to the hollow rod string may be removed and lowered in one single run. A production tubing is not used since the pumped fluid will rise to the surface through the interior of the hollow rod string.

Figure 2:
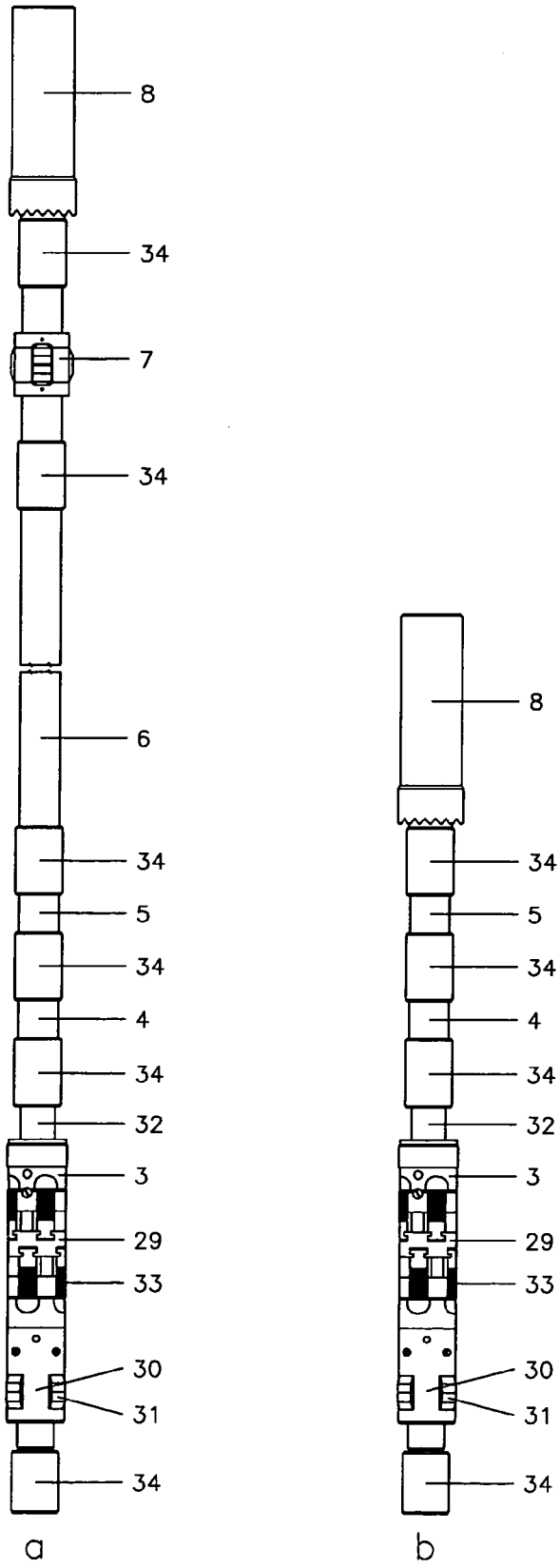
FIG. 2 shows two schematic views for two embodiments (a) and (b) of the stationary bottom set.
Figure 4:
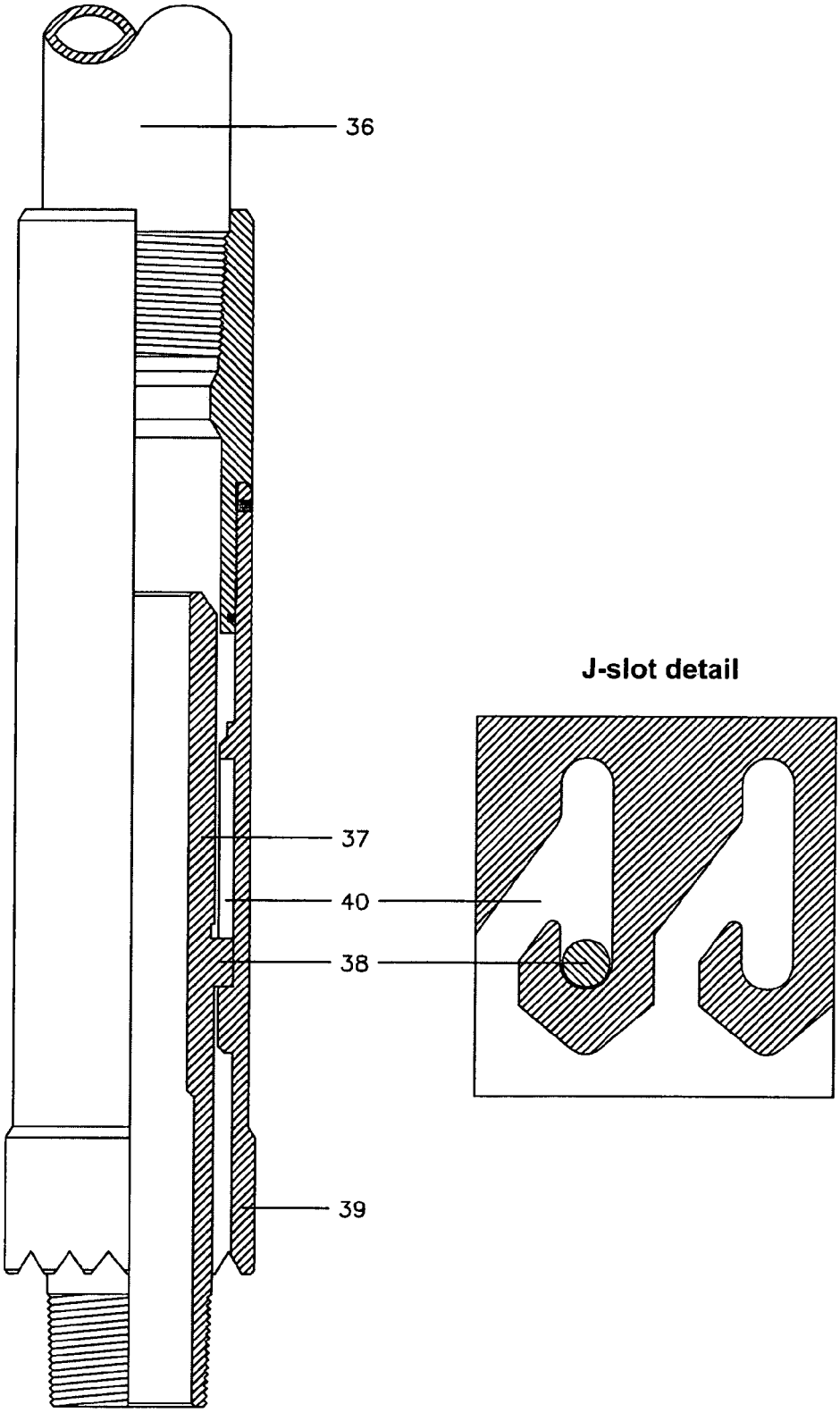
FIG. 4 shows a sectional schematic view of an exemplary connector set used to lower and fix the stationary bottom set.

The stationary bottom set is attached to the casing 1 by means of the anchor 3. The anchor has the necessary attachment means of the type to allow the free flow of fluid, so that the fluid entering the well through the layers placed above the anchor may access the admission opening 2. The mechanical and in cups seating shoes 4 and 5, respectively, are located immediately above the anchor and forming part of the bottom set. Then, the bottom set comprises a pump housing tube 6 and, above it there is a centralizer 7 that together with the anchor 3 keeps the bottom set in concentric position with respect to the casing 1 in all its extension. Finally, in the upper part of the bottom set, there is a connecting set 8, that is connected by its upper end to a tubing used for the descending run. Said connector has a "J" pin and slot system, as shown in FIGS. 2 and 4 and described below, that allows to disassemble the bottom set once it is fixed to the desired depth and to recover the tool used for the descending run.

The deep well pump illustrated in FIG. 1, is of the axial reciprocating movement type. Such pump comprises a stationary valve 11, a barrel or stationary member 12 and, inside thereof it has a mobile member housing the traveling valve 13 and the piston-pull tube set 14-15. The pump is lowered integral to the bottom end of string formed by a series of hollow rods 18 centered and interconnected by means of connecting sleeves 20. A centralizer 16 located in the upper part of the pump stationary member 12, allows to keep the pump in a concentric position with the casing walls 1 easing its entry to the bottom set. Underneath the stationary member 12 and integral to it, the pump has two anchors, mechanical 9, and in cups 10 which, upon reaching the stationary bottom set and due to the weight of the tool itself, enter into and anchor in their corresponding seats within the set.

The pump mobile member pull tube 15, is connected to the rod string 18 by means of the flow linking and drain tube 17 (nipple) that allows the pumped fluid to pass from the inside of the pump to the interior of the hollow rod string. Said linking tube provides a drain plug 41 as described below referring to FIG. 5.

The upper free end of the hollow rod string 18, is connected to the hollow polished rod 24 that extends outside the well. The connection between both is carried out by means of the connecting sleeve 20. Such hollow rod 24 driving the fluid along the inner part, is suspended by the clamp and crosspiece set 25 of the system, which by means of a driving force (not shown) provides the reciprocating axial pumping movement.

The hollow polished rod 24 is connected by its upper end to the production bridge through a rotating joint 26. Said production bridge formed of rigid articulate tubes 27, is connected by its free end to the surface driving pipeline 28. The connection between both tubes to the driving pipeline is also carried out through the rotating joints 26 that allow the production bridge to accompany the reciprocating axial movement of the polished rod.

At the exit of the well at the surface, a rigid head 22 is threaded to the end of the casing tube 1. Said head provides a side exit 21 that allows the disposal of fluids, gases, etc. through a valve, that may spontaneously arise from the annular space formed between the hollow rod string 18 and the casing tube 1.

FIG. 2 shows a detail view of the stationary bottom set, that is lowered to the well bore in an independent run upon its termination. The anchor 3, located in the bottom part of the set comprises an attachment system 29 and a centralizer hub 30 provided with friction blocks 31. The wedges 33 that will attach the anchor to the casing tube 1 are actuated by rotating the chuck 32 clockwise and applying weight first and then stress. The set continues upwards with the mechanical seating shoes 4 and in cups 5 respectively, the pump housing tube 6, the centralizer 7 and finally the connecting set 8, as shown in FIG. 2(*a*).

The pump housing tube 6 is formed by a portion of production tubing, for instance, about 2.⅞" (73 mm) in diameter and about 6,5 pounds/inch (128 kg/m) in weight. The length of this tube will depend on the length of the pump to be lowered. When big pumps, above 2" in diameter, that do not run through the interior of the housing tube 6 are used, this element and the next upper centralizer 7 are removed from the bottom set that is adapted to receive pumps of any dimension, which will depend on the size of the casing tube 1. When the size of the pump to be lowered is not known for certain, or when an increase in the future production is expected, it is recommended to use the reduced bottom set that comprises the anchor 3, the mechanical 4 and in cups 5 seating shoes, and the connecting set 8 as shown in FIG. 2(*b*). All the elements which are part of the bottom set are in general provided with API threaded ends and are connected to each other by standard API couplings 34.

Figure 3:
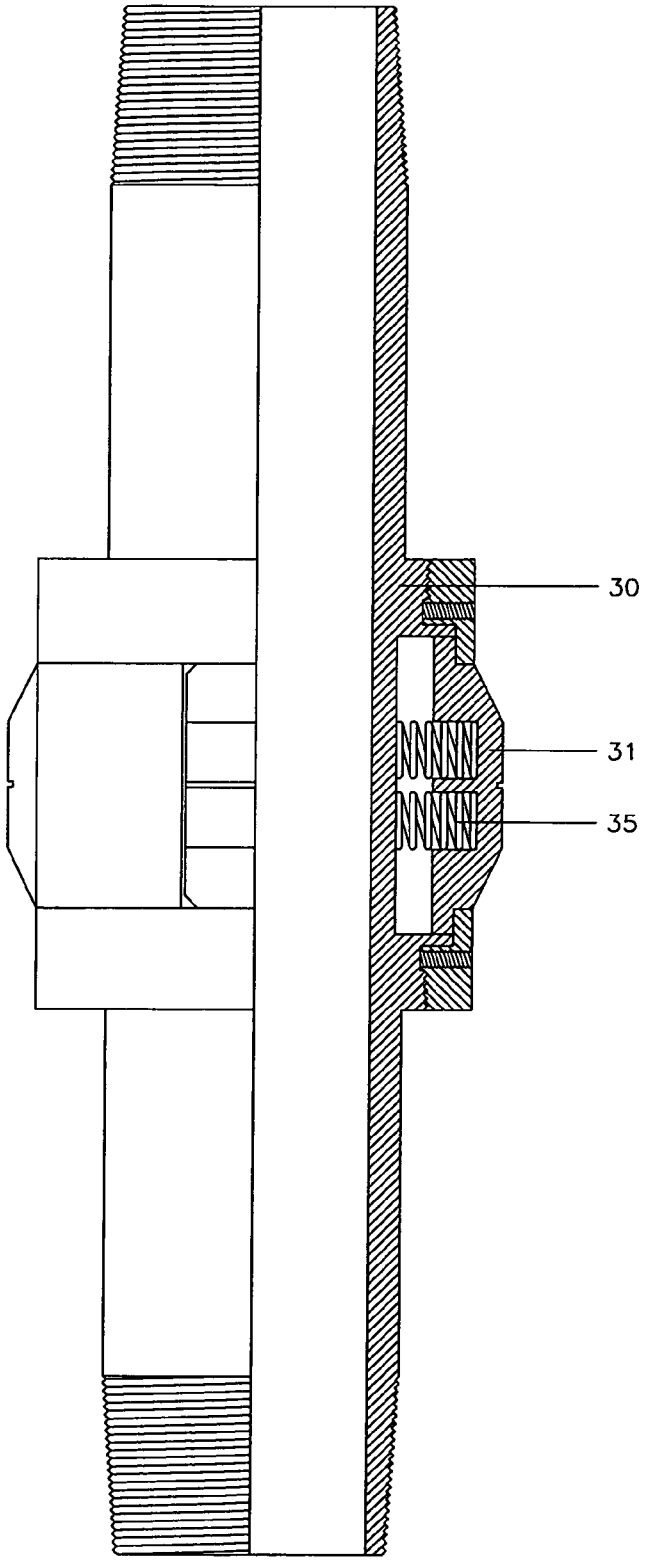
FIG. 3 shows a sectional schematic view of an exemplary centralizer used in the stationary bottom set and in the deep well pump.

FIG. 3 shows a sectional view of a centralizer, such as those identified by 7 and 16 in FIG. 1, as well as the centralizer that is part of the anchor, mentioned above, used to centralize the bottom set and the pump. Said centralizer is formed by a centralizer hub 30 equipped with friction blocks 31 which are actuated by springs 35 that keep them in permanent contact with the casing tube wall 1 in order to guide the descent and preserve the concentric position with the latter.

FIG. 4 shows a sectional view of the connector set 8, which is located in the upper part of the bottom set next to the centralizer 7 and is connected by its upper free end to the tubing 36 used for lowering the bottom set to the interior of the well. Said connecting set comprises a connecting tube 37 equipped with two pins 38 transverse to the tube, and a connecting hood 39 equipped with a "J" shaped slot 40. The tube pins 38 engage perfectly in the hood "J" shaped slot 40 to couple the connecting tube-hood set 8. This connector allows to drive the anchor 3 attachment means by rotating clockwise and applying weight and stress consecutively. Once the stationary bottom set is fixed at the desired depth, the pin 38 and "J" 40 system allow to dismantle the connecting hood 39 from the connecting tube 37 integral to the bottom set and to recover the tool used for lowering it.

Figure 5:
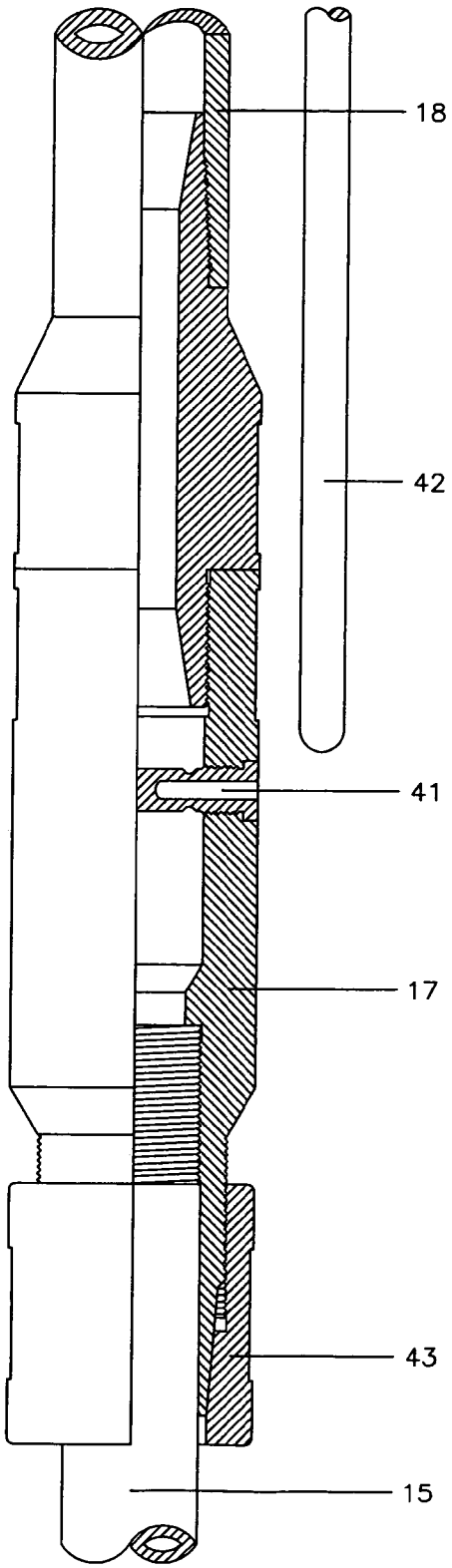
FIG. 5 shows a detail sectional schematic view of an exemplary flow linking and drain tube that links the pump pull tube with the centered hollow rod string.

FIG. 5 shows a sectional view of the linking flow and drain tube 17 that links the pump pull tube 15 with the hollow rod string 18. Such linking tube consists of a drain plug 41 that breaks by cut effort. A javelin 42 is released from the surface through the string interior to reach and break the drain plug 41. This maneuver gives an orifice open to the annular space that allows to empty the rod string when removing the pump. The connection 43 between the connection tube and the pump pull tube is of flexible type that allows to displace the bending efforts of the last pull tube thread, wherein the bending efforts that cause the break due to fatigue are mostly concentrated.

Figure 6:
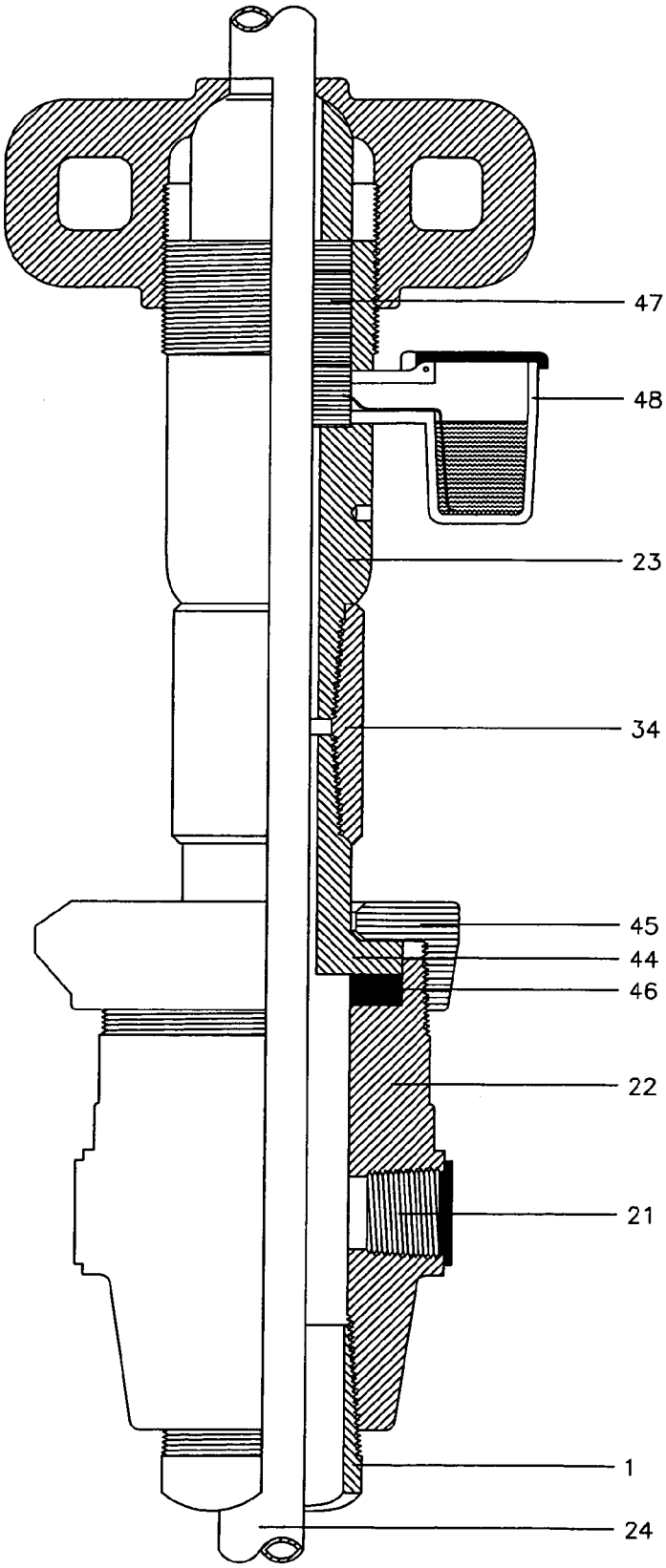
FIG. 6 shows a detail sectional schematic view of an exemplary rigid head with the seal box and the lubricating device that packs the annular space and lubricates the hollow polished rod.

FIG. 6 shows a sectional view of the rigid head 22 that is threaded to the upper end of the casing tube 1. Such head provides a side exit 21 allowing the venting of the annular space between the rods and casing and an adaptor 44 that has a thread, such as an API 2.⅞" (73 mm) thread to assemble a seal lubricating box 23 by means of a standard coupling 34, such as, for instance, an API 2.⅞" (73 mm) coupling. Such adaptor is adjusted to the head body by means of a threaded cup 45. A ring 46, such as a rubber ring, packs the adaptor against the head body. The internal diameter of said body head offers a continuous passage to the inside of the casing, therefore, all the tools lowered to the well hole are passed through the head without disassembling it. A set of seals 47 placed within the seal box 23 and a lubricating element 48 adapted thereto, allow to pack the annular space at the rod exit outside the well and to lubricate the friction surface between the rod and the seals. For wells of 3.⅓"-88,9 mm (slim hole) casings it may only optionally be used a conventional compact T-press coupled to the casing that provides the side exit and the seal box that packs the annular space between rod and casing. In any of the arrangements, the seal box also has a device to lubricate the polished rod, since it works in dry conditions when the fluid produced flows inside thereof.

Figure 7:
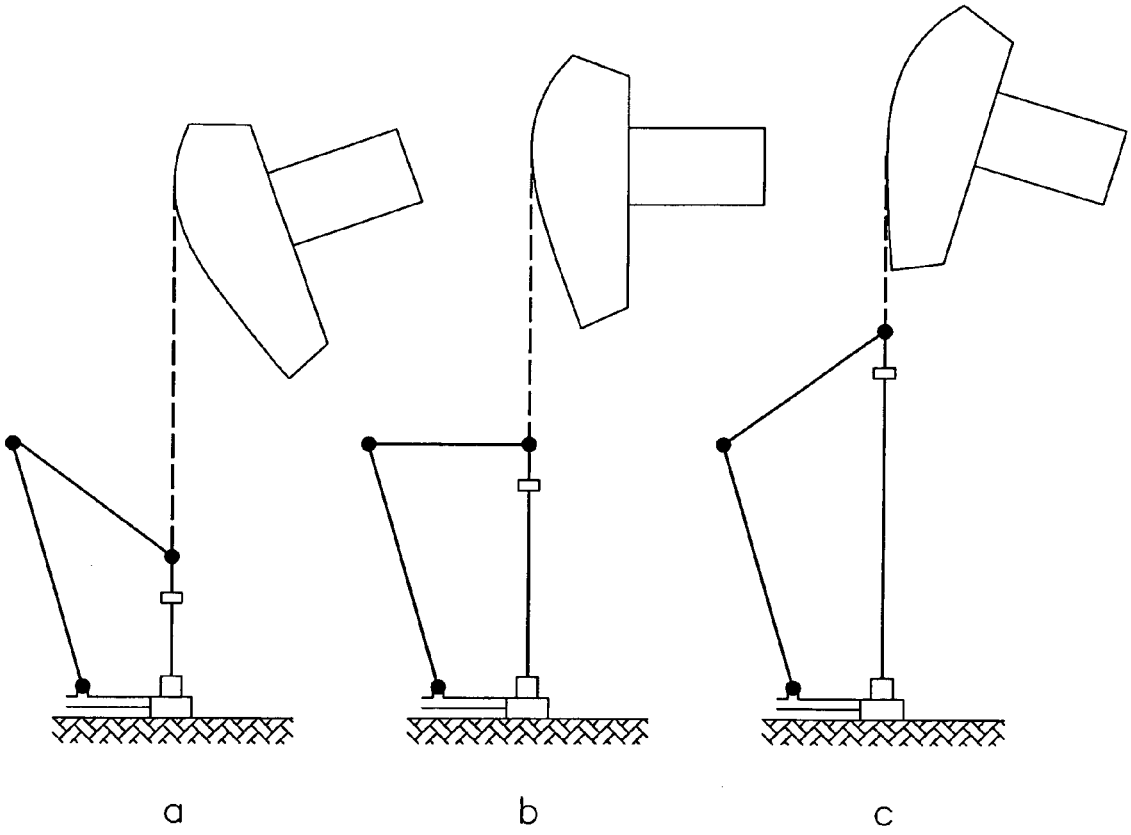
FIG. 7 schematically shows the positions (a), (b) and (c) of the production bridge according to a preferred embodiment, while it accompanies the hollow polished rod in its axial movement, from the bottom dead point to the top one.

FIG. 7 schematically shows the positions to be taken by the articulate production bridge during the reciprocating axial movement of the polished rod. Schemes (a), (b) and (c) depict the polished rod position in the bottom dead center, mid-center, and top dead center.

According to a particular embodiment, even when it is not limiting, the anchor 3 used in the stationary bottom set of the present invention, was obtained from the modification of a Lokset Baker® packing device. Such modification includes: the removal of the rubber section packing against the casing 1, the removal of the seal packing over the mandrel, the shortening of the mandrel 32 (due to the removal of the packing rubber) and the modification of the mandrel thread as well as the modification of the segments that actuate the attachment mechanism to avoid its interlock and blocking with sand. By this way, an anchor was obtained to allow the free fluid flow entering the well from the layers placed above said anchor, and the attachment force of which is trapped inside, therefore, it does not need to remain stressed as the majority of the anchors used in the conventional system. The ability of the anchor 3 to remain still and neutral allow to disassemble the connecting set 8 and recover the tubing 36 used for lowering the stationary bottom set, as shown in FIG. 2. For wells with 3.½"-88,9 mm (slim hole) casings, a useful anchor that is lowered coupled on the bottom part of the deep well pump and in the same run, is the 3.½"-88.9 mm anchor for insert pumps, supplied by Harbison-Fisher, without a packing element.

According to a particular embodiment, the connecting set 8, used for this arrangement, shown in FIG. 4, is similar to the Sealing Connector by Backer®, 2.⅞" (73 mm) in diameter, which seals have been removed between the tube 37 and the hood 39 and the top end inner cone of tube 37 has been enlarged to ease the entry of the pump to the bottom set.

Preferably, the seating shoes 4 and 5 used in the bottom set are standard API mechanical and in cups type, respectively.

The centralizers 7 and 16 are obtained from the centralizing block of the packing Lokset Backer® device, as shown in FIG. 3.

The rod pump used for this embodiment is an API reciprocating axial pump with a hollow pull tube and double mechanical anchorage 9 and in cups 10. A centralizer 7 was added to such pump in its top part and integral to the stationary member 12, for guiding the descent into the well and for easing in the entry to the stationary bottom set, as shown in FIG. 1.

According to an embodiment of the present invention, hollow rods and connecting sleeves made by Tenaris under the name of PCPRod® may be used, although not limited to them.

Although these rods have been developed to be used with PCP progressive openings pumps due to their higher torsion resistance and fatigue to flexo-torsion with constant axial load, they have also shown to be resistant to variable axial efforts. Recent fatigue analysis with variable axial loads carried out over the PCPRod® rod have shown that both the rod and the bond may stand more than 10 MM cycles without breaking. Hydraulic estimations for load losses through the interior of the hollow rods and their corresponding links for different flow rates up to a maximum of 90 m 3/day have also been made, the results of which showed to be similar to those of conventional reciprocating pumping for production tubings of 2.⅞" (73 mm) diameter and API solid rod strings No. 76 (double telescopic strings of ⅞" (22,2 mm) and ¾" (19,05 mm) in diameter and No. 86 (triple telescopic strings of 1" (25,4 mm), ⅞" (22,2 mm) and ¾" (19,05 mm) in diameter). Even though the hollow rod string is, in general, heavier than a solid string, the requests about the means that imparts the reciprocating axial movement to the rods are not significantly modified due to the lower weight of the fluid column (minor section) and the lack of relative movement between the rod and the fluid in the ascending run that eliminates the load losses thus compensating the higher string weight.

Preferably, the PCPRod® 1000 model without jump, with an external diameter of 48 mm (1.889"), internal diameter of 34,6 mm (1.362"), wall thickness of 6,7 mm (0.264") and 6 Kg/m (4 pounds/feet) in weight may be used and, more preferably, the PCPRod® 1500 model with jump, external diameter of 50 mm (1.968"), body external diameter of 42 mm (1.653"), internal diameter of 32 mm (1.259"), wall thickness of 5 mm (0.196") and 4,9 Kg/m (3.28 pounds/ft) in weight. The rod centralizers 19 may be, for example, Poli Phenylene Sulfide, (PPS) type, supplied by Tenaris, vulcanized over the rod in the requested amount and diameter, not being limited to them.

According to a particular embodiment, the rigid head type 22 used for this arrangement was obtained from the API DC 200 hanging head manufactured by ABB (ex DANCO) or similar, without clamps, to which an adaptor 44 was added. The seal box 23 with lubricating device 48 that is an adaptation of a box manufactured by TULSA@.

As can be seen from the above description, and in a comparative analysis in relation to the prior art, the total elimination of the conventional production tubing, as well as the elimination of the solid rod string as the axis actuating the reciprocating axial pump is emphasized first, for its replacement by a hollow rod string that performs both roles simultaneously. This novel configuration, built up from existing elements and simple modifications made therefrom allows to obtain a high performance reciprocating pumping system and most relevantly, easy to install and operate, that adapts to any casing and rod pump size, which makes it possible to perform drillings of significantly smaller diameter than those for conventional wells, which usually have a diameter of about 21,6 cm (8½ inches). This reduction in the well diameter will additionally mean a reduction in the casing tubing diameter, which entails a reduction in the drilling costs and the materials used.

According to an additional embodiment of the present invention, a method of extracting a fluid from a drilled well within a geological formation is provided, which walls are secured by a casing, perforated at selected depth levels, by means of the above disclosed assembly, comprising the following steps:

a) assembling and lowering a stationary bottom set into the well, attaching it to the casing walls at the desired depth and recovering the tool used for the descent;

b) building an anchoring system in the bottom end and a centralizer in the top end of an axial reciprocating movement rod pump stationary member, connecting the mobile end of the pump to a centralized hollow rod, wherein such connection is of the type that enables the pumped fluid to pass from within the pump to the interior of the hollow rod;

c) interconnecting a centralized hollow rod string by means of sleeves, to form a string that extends into the well, until anchoring the pump in the bottom set;

d) connecting a hollow polished rod to the free end of the hollow rod string by means of a sleeve and suspending said polished rod of the system that imparts the reciprocating axial movement;

e) installing a surface head that provides a venting orifice of the annular space formed between the casing and the polished rod and a gasket between the casing and the polished rod extension outside the well;

f) assembling the upper end of the polished rod to a production bridge equipped with rotating joints that allow its connection to the surface driving tubing;

g) actuating such hollow polished rod according to a reciprocating axial movement;

h) recovering the pumped fluid that flows up from the interior of the hollow rod string and the hollow polished rod and deliver it through the production bridge to the surface driving pipeline.

Considering that the minimum drilling depth for exploiting hydrocarbons is 400 mts, with the possibility of reaching up to 4500 mts, the cost reduction achieved by using the device of the present invention will be evident for those skilled in the art, even if the stationary bottom set is lowered in a separate run.

It has been found that the pumping assembly and method of the present invention may provide an efficient extraction service for oil wells of depths up to 2500 meters and with average flow rates of about 90 $m^3$ oil/day.

Preferably, the pumping assembly and method of the present invention may provide an efficient extraction service for oil wells of depths up to 2200 meters.

Preferably, the pumping assembly and method of the present invention may be applied to pumping flow rates of about 80 $m^3$/day of fluid, wherein the fluid is preferably oil.

It must be understood that the drawings and their detailed description are not intended to limit the invention to the particular described embodiment; but on the contrary, they intend to encompass all modifications, equivalents and alternatives comprised within the spirit and scope of the present invention, as defined in the annexed claims.

The invention claimed is:

1. An assembly for extracting a fluid from a drilled well within a geological formation, which walls are secured by means of a casing that is drilled at pre-selected depth levels, the device comprising:

a) a stationary bottom set configured to anchor to the casing for a deep well pump, the stationary bottom set including an anchor comprising an attachment system to the casing and a centralizer hub equipped with friction blocks, mechanical-type and cup-type seating nipples, and a connecting set;

b) a deep well pump with reciprocating axial movement comprising a stationary member and a mobile member, an anchorage system in the bottom part, and a centralizer in the top part, the latter two being integral to the stationary member;

c) a series of interconnected hollow sucker rods forming a string that extends within the well and is connected by its bottom end to the mobile member of the rod pump, such that the inside of the mobile member of the pump is in fluid communication with the interior of the hollow rod string;

d) a hollow polished rod that is connected by its bottom end to the free top end of the hollow rod string within the well, said polished rod being linked to a system that imparts a reciprocating axial movement;

e) a production bridge that links the top end of the hollow polished rod to the driving pipeline, which allows the recovery of the fluid pumped from the interior of the hollow rods and from said hollow polished rod; and f) a rigid head providing a packing in the annular space between the polished rod and the casing, equipped with a hollow polished rod lubricating device.

2. The assembly according to claim 1, wherein the stationary bottom set further comprises a housing tube for the pump and a centralizer thereof.

3. The assembly according to claim 1, wherein the attachment system of the anchor are of the type that allows for free fluid flow.

4. The assembly according to claim 1, wherein the connecting set comprises a connecting tube equipped with pins transversal to the tube axis and a connecting hood provided with a "J"-shaped slot, so that the pins fit in the "J" slot of the hood to assemble the tube-hood connector set.

5. The assembly according to claim 1, wherein the reciprocating axial movement rod pump comprises a stationary member or barrel provided with a stationary valve and a mobile member comprising a traveling valve and the piston-pull tube set.

6. The assembly according to claim 5, wherein the pull tube is connected to the hollow rod string by means of a flow linking tube that enables the fluid flow from within the pump mobile member to the interior of the hollow rod string.

7. The assembly according to claim 6, wherein the flow linking tube has a drain plug, susceptible of being sectioned for its opening, during the pump extracting maneuvers.

8. The assembly according to claim 6, wherein the flow linking tube is connected with the pump pull tube by means of a flexible connection.

9. The assembly according to claim 5, wherein the stationary member has a mechanical anchorage and an anchorage in cups for anchoring in the respective mechanical-type and cup-type seating nipples, of the stationary bottom set.

10. The assembly according to claim 1, wherein the centralizers comprise a centralizer hub equipped with friction blocks, and actuated by springs.

11. The assembly according to claim 1, wherein the hollow rod string comprises female threaded end tubes, interconnected by means of male threaded end tubular sleeves.

12. The assembly according to claim 11, wherein the hollow rod string has at least one centralizer surrounding it.

13. The assembly according to claim 1, wherein the connection between the hollow polished rod and the production bridge is a rotating joint.

14. The assembly according to claim 1, wherein the production bridge comprises rigid tubes connected to one another and to the driving pipeline by rotating type joints.

15. The assembly according to claim 1, wherein the rigid head is threaded to the casing tube top end, said head being further equipped with a venting valve from the annular space formed between the hollow polished rod and the casing.

16. The assembly according to claim 1, wherein the rigid head comprises a seal box with a lubricating device that allows for packing the annular space at the polished rod exit outside the well and for lubricating the friction surface between polished rod and seals.

17. The assembly according to claim 1, wherein the fluid is a hydrocarbon.

18. A method for extracting a fluid from a drilled well within a geological formation, which walls are secured by means of a casing, perforated to selected depth levels, by means of the assembly according to claim 1, the method comprising:

a) assembling and lowering a stationary bottom set into the well, attaching it to the casing walls at the desired depth and recovering the tool used for the descent;

b) building an anchoring system in the bottom end and a centralizer in the top end of an axial reciprocating movement rod pump stationary member, connecting the mobile end of the pump to a centralized hollow rod, wherein such connection is of the type that enables the pumped fluid to pass from within the pump to the interior of the hollow rod;

c) interconnecting a series of hollow sucker rods by means of sleeves, to form a string that extends into the well, until anchoring the pump in the bottom set;

d) connecting a hollow polished rod to the free end of the hollow rod string by means of a sleeve and suspending said polished rod of the system that imparts the reciprocating axial movement;

e) installing a surface head that provides a venting orifice of the annular space formed between the casing and the polished rod and a gasket between the casing and the polished rod extension outside the well;

f) assembling the upper end of the polished rod to a production bridge equipped with rotating joints that allow its connection to the surface driving tubing;

g) actuating such hollow polished rod according to a reciprocating axial movement; and h) recovering the pumped fluid that flows up from the interior of the hollow rod string and the hollow polished rod and delivering it through the production bridge to the surface driving pipeline.

19. The method according to claim 18, wherein the fluid is a hydrocarbon.

* * * * *

UNITED STATES PATENT AND TRADEMARK OFFICE

CERTIFICATE OF CORRECTION

PATENT NO. : 7,647,962 B2
APPLICATION NO. : 11/447606
DATED : January 19, 2010
INVENTOR(S) : Ruggeri et al.

It is certified that error appears in the above-identified patent and that said Letters Patent is hereby corrected as shown below:

Title Page, Item (57) ABSTRACT, lines 4-5, "bottom set that attached"
should read -- bottom set attached --

Signed and Sealed this

Eleventh Day of May, 2010

David J. Kappos

David J. Kappos
*Director of the United States Patent and Trademark Office*